US006800043B1

(12) United States Patent
Pohrer

(10) Patent No.: US 6,800,043 B1
(45) Date of Patent: Oct. 5, 2004

(54) HEIGHT-ADJUSTABLE VOLLEYBALL NET AND STANDARD SYSTEM AND METHOD

(75) Inventor: Christopher M. Pohrer, St. Louis, MO (US)

(73) Assignee: AALCO Manufacturing Company, St. Louis, MO (US)

( * ) Notice: Subject to any disclaimer, the term of this patent is extended or adjusted under 35 U.S.C. 154(b) by 406 days.

(21) Appl. No.: 09/692,641

(22) Filed: Oct. 19, 2000

(51) Int. Cl.[7] ..... A63B 61/02
(52) U.S. Cl. ..... 473/493; 473/492; 473/422
(58) Field of Search ..... 473/492–494, 473/416, 459, 428–430, 422; 273/400, 402, 407

(56) References Cited

U.S. PATENT DOCUMENTS 1,998,454 A * 4/1935 Gordon ..... 473/492
3,940,139 A * 2/1976 Barnes ..... 473/494
4,122,451 A 10/1978 Senoh
4,153,247 A * 5/1979 Burns ..... 473/416
4,720,112 A 1/1988 Stettner et al.
4,830,382 A * 5/1989 Wheeler ..... 473/492
4,968,042 A 11/1990 Stewart
5,102,127 A 4/1992 Pohrer
5,215,310 A * 6/1993 Allbright ..... 473/493
5,308,085 A * 5/1994 Koole ..... 473/493
5,358,257 A * 10/1994 Pardi ..... 473/493
5,393,051 A 2/1995 Merino et al.
5,611,539 A * 3/1997 Watterson et al. ..... 273/400
5,860,877 A 1/1999 Esser

* cited by examiner

*Primary Examiner*—Mitra Aryanpour
(74) *Attorney, Agent, or Firm*—Thompson Coburn, LLP

(57) ABSTRACT

A method for adjusting the height of a volleyball net comprises operatively connecting a net-supporting cable, which supports a net, to upper post sections, tensioning the net-supporting cable to a net-supporting tension which is sufficiently great that first and second ends of the net's upper edge margin does not exceed the elevation of the mid-point of the net's upper edge margin by more than approximately ¾" (2 cm) when the first and second ends of the net's upper edge margin are at approximately the same elevation, and moving the upper post sections between raised and lowered positions without reducing the tension of the cable below the net-supporting tension.

12 Claims, 2 Drawing Sheets

HEIGHT-ADJUSTABLE VOLLEYBALL NET AND STANDARD SYSTEM AND METHOD

BACKGROUND OF THE INVENTION

This invention relates to height adjustable nets for use in games such as volleyball.

Volleyball regulations have specific requirements for the volleyball court and equipment. A volleyball net is required to be 3 feet (1 meter) wide and at least 32 feet (9.5 meters) in length. The upper edge margin of the net comprises an elongate sleeve through which a net-supporting cable extends. Typically, the net is attached to upright standards via the net-supporting cable. Preferably, the standards are 3 feet (1 meter) outside a volleyball court's sidelines. The width of the court (i.e., the distance between the sidelines) is 9 meters. The height of the net is measured at the center of the net and is required to be 7 feet, 11⅝ inches (2.43 meters) for men and 7 feet, 4⅛ inches (2.24 meters) for women. The net height measured at the ends of the net is not permitted to exceed the center height by more than ¾ inch (2 millimeters). In other words, the net cannot sag by more than ¾ inch (2 at its center. To prevent excessive sag, the net-supporting cable must be maintained at a sufficient tension.

Because the net's height requirements are different for men's volleyball and women's volleyball and because men's and women's volleyball are played on the same courts but at different times, it is often necessary to change the net's height. In prior art net/standard systems, the net height is varied by first relieving the tension on the net-supporting cable and then lowering the standard. After the net is positioned at its new height, the net-supporting cable is re-tensioned to prevent excessive sag. Changing the net height in this manner is time consuming. Also, it is difficult when changing the height to obtain the precise required height. This is because the net's height increases slightly upon tensioning of the net-supporting cable. Unless the increase caused by the tensioning is taken into account before the cable is tensioned, it will be necessary to again relieve the tension of the cable, lower the net to the proper height, and then re-tension the cable.

SUMMARY OF THE INVENTION

Among the features and advantages of the present invention may be noted the provision of an improved method of changing the height of a volleyball net; the provision of such a method in which the net height may be adjusted quickly and easily; the provision of such a method in which the net height may be varied without relieving tension on the net-supporting cable; and the provision of an improved height-adjustable net and standard system.

Generally, a method of the present invention for adjusting the height of a volleyball net comprises securing first and second net standards to a support surface, such as a floor, in a manner so that the net standards extend up from the support surface in a generally upright position. Each net standard comprises a lower post section and an upper post section slidably connected to the lower post section for telescoping movement of the upper post section relative to the lower post section along a post axis between a raised position and a lowered position. A net and cable assembly is provided. The net and cable assembly comprises a net and a net-supporting cable. The net has an upper edge margin and a cable-receiving sleeve at its upper edge margin. The upper edge margin has first and second ends and a mid-point midway between the first and second ends. The net-supporting cable extends through the cable-receiving sleeve of the net. The method further comprises operatively connecting the net-supporting cable to the upper post sections of the first and second net standards in a manner so that the net is between the first and second net standards and extends downward from the net-supporting cable, tensioning the net-supporting cable to a net-supporting tension which is sufficiently great that the elevation of the first and second ends of the net's upper edge margin does not exceed the elevation of the mid-point of the net's upper edge margin by more than approximately ¾" (2 cm) when the first and second ends of the net's upper edge margin are at approximately the same elevation, and moving the upper post sections of the first and second net standards between their raised and lowered positions without reducing the tension of the cable below the net-supporting tension.

Another aspect of the present invention is a height-adjustable net and standard system for use in ball games such as volleyball. The net and standard system comprises first and second net standards, a net, a net-supporting cable, and at least one tension adjusting mechanism. The net standards are adapted for being secured to a support surface, such as a floor, in a generally upright orientation so that the first and second net standards are horizontally spaced from one another. The net has an upper edge margin, a lower edge margin, and side margins. The net has a cable-receiving sleeve at its upper edge margin. The net is adapted to be supported by and extend between the first and second net standards. The net-supporting cable is adapted for extending through the cable-receiving sleeve of the net and for supporting the net between the net standards. Each of the first and second net standards comprises a lower post section, an upper post section and a drive mechanism. The upper post section is slidably connected to the lower post section for telescoping movement of the upper post section relative to the lower post section along a post axis between a raised position and a lowered position. The drive mechanism is operatively connected to the upper and lower post sections. The drive mechanism is operable in a manner to axially move the upper post section relative to the lower post section between its raised and lowered positions. The tension adjusting mechanism is attached to the upper post section of the first net standard and is adapted to tension the net-supporting cable in a taut configuration between the first and second net standards. The drive mechanism is adapted to move the corresponding upper post section between its raised and lowered positions even when the cable is tensioned by the tension adjusting mechanism.

Other objects and features will be in part apparent and in part pointed out hereinafter.

BRIEF DESCRIPTION OF THE DRAWINGS

Corresponding reference characters indicate corresponding parts throughout the several views of the drawings.

DESCRIPTION OF THE PREFERRED EMBODIMENT

Figure 1:
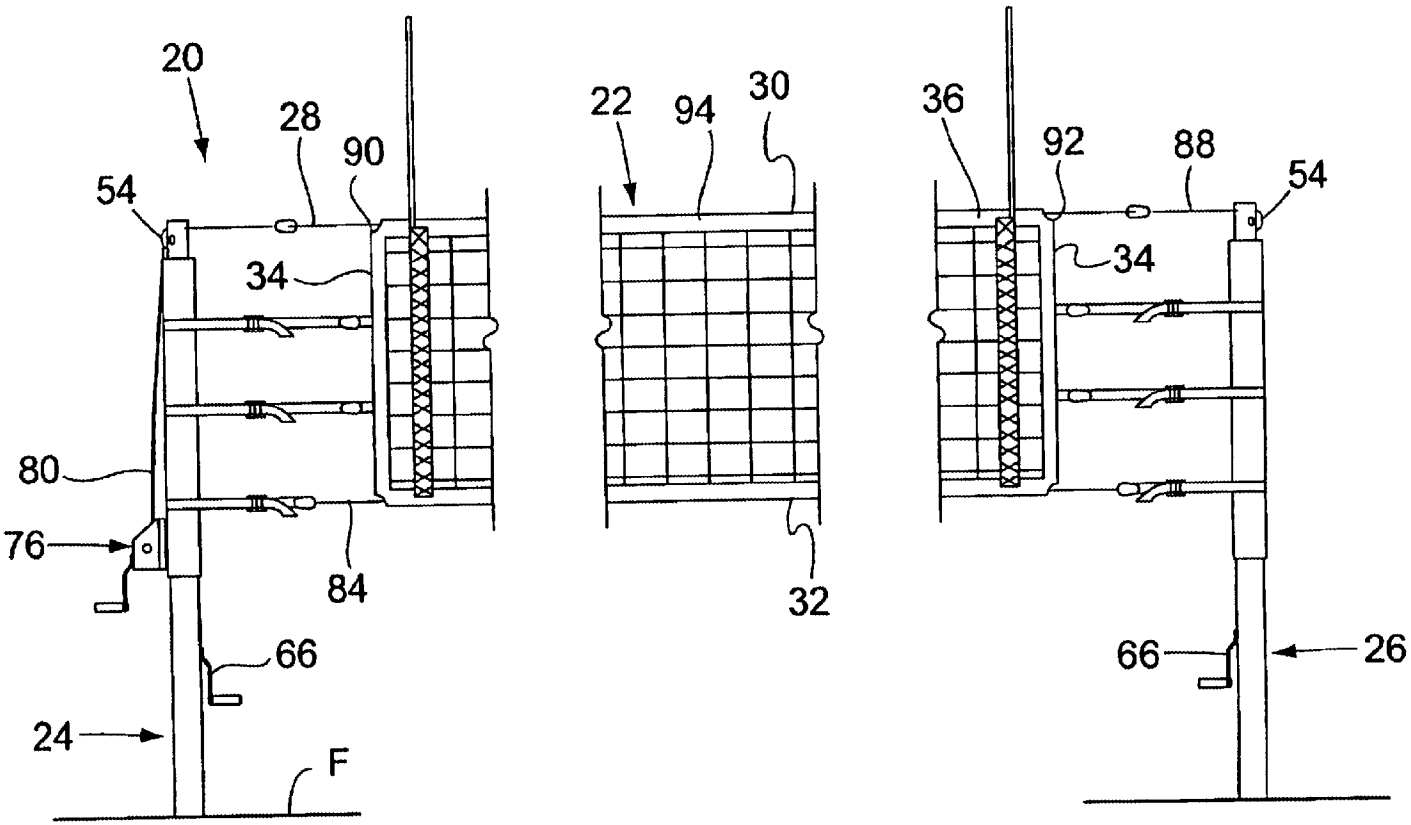
FIG. 1 is a front elevational view of a net and standard system of the present invention, the net and standard system having a net and first and second standards for supporting the net.

A volleyball net and standard system of the present invention is indicated generally in FIG. 1 by reference numeral 20. The net and standard system 20 comprises a volleyball net, generally indicated at 22, and first and second net standards, generally indicated at 24, 26, respectively. The net 22 is releasably attached to the standards 24, 26 via a net-supporting cable 28. The net 22 has an upper edge margin 30, a lower edge margin 32, and side margins 34. The upper edge margin 30 of the net 22 constitutes an elongate cable-receiving sleeve 36 extending, preferably extending the entire length of the net. The net-supporting cable 28 extends through the cable-receiving sleeve 36 of the net 22 and, as discussed in greater detail below, is operatively connected to the net standards 24, 26 in a manner so that the cable is in tension with the net depending from the cable.

Figure 2:
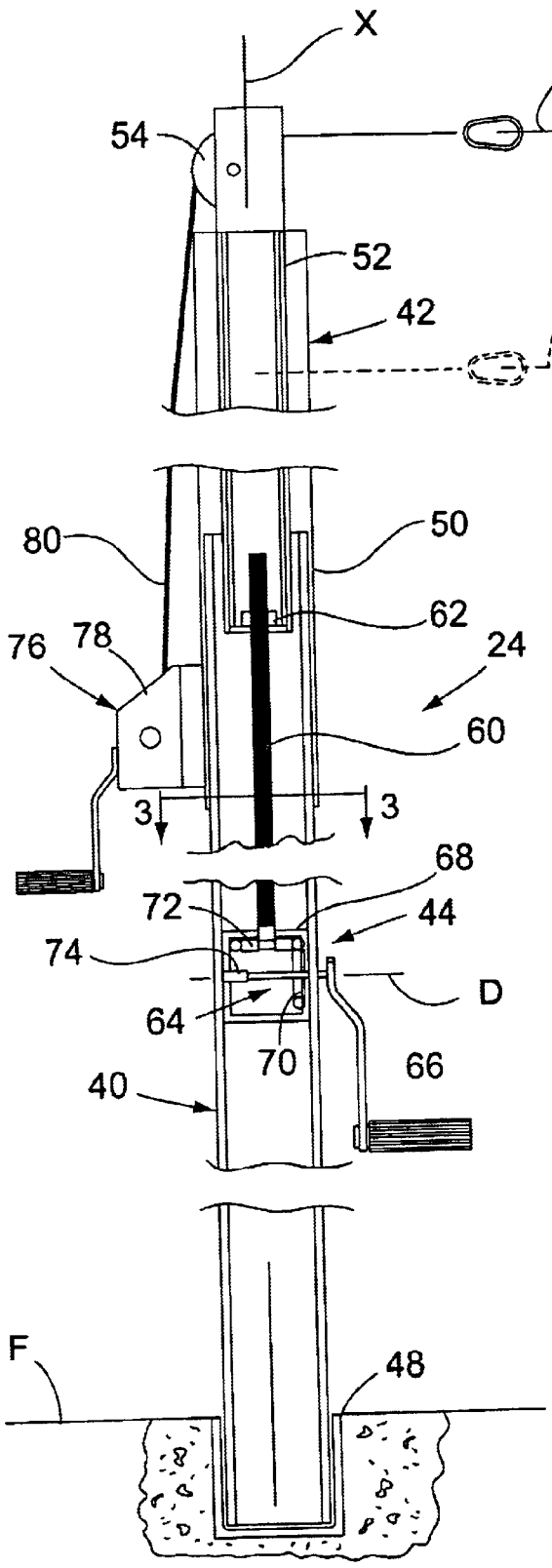
FIG. 2 is a longitudinal cross-sectional view of the first standard of the net and standard system of FIG. 1.
Figure 3:
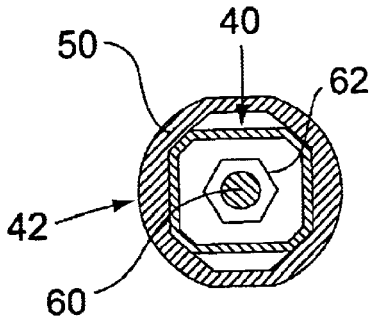
FIG. 3 is a cross-sectional view taken along the plane of line 3—3 of FIG. 2.

Referring to FIGS. 2 and 3, each of the first and second net standards 24, 26 comprises a lower post section, generally indicated at 40, an upper post section, generally indicated at 42, and a drive mechanism, generally indicated at 44. The lower post section 40 is preferably an extruded aluminum tube. The lower post section 40 is preferably releasably attached to a support surface, such as a floor F, via a conventional post-receiving sleeve 48 (FIG. 2) embedded into the support surface. The lower post section 40 and sleeve 48 mate with one another in a manner so that the lower post section is in a generally upright orientation relative to the support surface.

The upper post section 42 comprises an outer slider tube 50 and an inner tube 52. The outer slider tube 50 is dimensioned for a sliding fit over the lower post section 40. The inner tube 52 has an outer diameter less than the inner diameter of the lower post section 40 and is adapted to extend down into the upper end of the lower post section. The outer slider tube 50 surrounds the inner tube 52 and is secured at its upper end to the inner tube. The inner slider tube 52 protrudes at its upper end from the outer slider tube 50. A pulley 54 is rotatably attached to the upper end of the inner tube 52. The upper post section 42 is adapted for telescoping movement relative to the lower post section 40 along a post axis X between a raised position and a lowered position. The net-supporting cable 28 is shown in both solid and in phantom in FIG. 2. The solid net-supporting cable 28 represents the height of the cable when the upper post section 42 is in its raised position. The phantom net-supporting cable 28 represents the height of the cable when the upper post section 42 is in its lowered position.

The upper post section 42 is moved between its raised and lowered positions via the drive mechanism 44. Preferably, the drive mechanism 44 is a screw-type drive mechanism having an elongate screw 60, a threaded adjuster member 62, a gear train, generally indicated at 64, and a crank 66. The elongate screw 60 extends along the post axis X and is journaled at its lower end to a suitable bearing block 68 for rotation of the screw about the post axis. The bearing block 68 is fixed to the inside of the lower post section 40 and prevents the screw 60 from moving axially relative to the lower post section. The threaded adjuster member 62 is fixed to the lower end of the upper post section's inner tube 52 and threadably engages the screw 60 so that rotation of the screw about the post axis X in one direction raises the upper post section and rotation of the screw in an opposite direction lowers the upper post section. The gear train 64 comprises a drive gear 70 and a driven gear 72. The drive gear 70 is preferably a bevel gear keyed to a drive shaft 74. The drive shaft 74 is preferably journaled to the lower post section 40 for rotation of the drive shaft 74 and drive gear 70 about a drive axis D. The drive shaft 74 and drive gear 70 are preferably rotated about the drive axis via the crank 66. The driven gear 72 is preferably a bevel gear keyed to the lower end of the screw 60 for rotation with the screw and engages the drive gear 70 in a manner to be turned by rotation of the drive gear. Thus, turning the crank 68 about the drive axis D rotates the drive gear 70, and rotation of the drive gear rotates the driven gear 72 and screw 60 about the post axis X to raise or lower the upper post section 42 relative to the lower post section.

Preferably, a tensioning mechanism 76 is secured to the upper post section 42 of the first net standard 24 for tensioning the net-supporting cable 28. A first end of the net-supporting cable 28 is operatively connected to the upper post section 42 of the first net standard 24 via the tensioning mechanism 76. A second end of the net-supporting cable 28 is connected to the upper post section 42 of the second net standard 26 either directly or via a strap connected to such upper post section. Preferably, the tensioning mechanism 76 comprises a winch mechanism having a winch 78 and a tensioning strap 80. The winch 78 is adapted for increasing or decreasing the effective length of the tensioning strap 80 (i.e., the distance between the winch 78 and the tensioning strap/cable connection). Operating the winch 78 to decrease the effective length of the tensioning strap 80 increases tension of the net-supporting cable 28. Operating the winch 78 to increase the effective length of the tensioning strap 80 decreases tension of the net-supporting cable 28. Although the tensioning mechanism 76 is preferably a winch mechanism, it is to be understood that any other suitable tensioning mechanism may be employed without departing from the scope of this invention. For example, the tensioning mechanism may comprise a mechanism which laterally deflects an intermediate portion of a strap to tension the strap or a mechanism which moves the strap in a longitudinal direction to change the tension of the cable.

Preferably, a lower cable 84 (FIG. 1) extends through a sleeve at the lower edge margin 32 of the net. The lower cable 84 is preferable connected to the upper post sections 42 via suitable hand-adjustable straps. The side margins 34 of the net 22 are preferably also connected to the upper post sections 42 via hand-adjustable straps. The hand-adjustable straps are adapted to be hand-tensioned to provide the desired tension in the net 22.

In operation, the first and second net standards 24, 26 are inserted into the post-receiving sleeves 48 on opposite sides of a volleyball court. The sleeves 48 are preferably spaced apart a distance of at least 32 feet. More preferably, the sleeves 48 are spaced apart a distance of 36 feet with each sleeve being 3 feet from the sideline of the court so that the standards 24, 26 are 3 feet from the sideline of the court. When properly positioned in the sleeves 48, the standards 24, 26 extend up from the floor F in a generally upright manner, preferably so that each post axis X is vertically oriented. With the net-supporting cable 28 extending through the cable-receiving sleeve 36 of the net 22, the first end of the cable is releasably attached to the tensioning strap 80 of the winch mechanism and the second end of the cable is releasably attached to the upper post section 42 of the second net standard 26 via a strap 88. The net-supporting cable 28 is positioned so that the cable is between the two pulleys 54 of the upper post sections 42. The net's upper edge margin 30 has first and second ends 90, 92 (FIG. 1) and a mid-point 94 midway between the first and second ends. With the two pulleys 54 preferably at the same elevation, the winch 78 is operated in a manner to tension the net-supporting cable 28 to a net-supporting tension which is sufficiently great so that the first and second ends 90, 92 of the net's upper edge margin 30 does not exceed the elevation of the mid-point of the net's upper edge margin by more than approximately ¾" (2 cm) when the first and second ends of the net's upper edge margin are at approximately the same elevation. Preferably, the distance between the two ends 90, 92 is at least 29.5 feet, and is more preferably 30 feet. The net-supporting cable 28 is preferably tensioned to this extent to meet the tension requirements of the volleyball regulations. After tensioning of the net-supporting cable 28, the In view of the above, it will be seen that the several objects of the invention are achieved and other advantageous results attained.

As various changes could be made in the above construction and method without departing from the scope of the invention, it is intended that all matter contained in the above description or shown in the accompanying drawings shall be interpreted as illustrative and not in a limiting sense.

What is claimed is:

1. A method of adjusting the height of a volleyball net comprising:

securing first and second net standards to a support surface, such as a floor, in a manner so that the net standards extend up from the support surface in a generally upright position, each net standard comprising a lower post section and an upper post section slidably connected to the lower post section for telescoping movement of the upper post section relative to the lower post section along a post axis between a raised position and a lowered position;

providing a net and cable assembly comprising a net and a net-supporting cable, the net having an upper edge margin and a cable-receiving sleeve at its upper edge margin, the upper edge margin having first and second ends and a mid-point midway between the first and second ends, the net-supporting cable extending through the cable-receiving sleeve of the net;

operatively connecting the net-supporting cable to the upper post sections of the first and second net standards in a manner so that the net is between the first and second net standards and extends downward from the net-supporting cable;

tensioning the net-supporting cable to a net-supporting tension which is sufficiently great that the elevation of the first and second ends of the net's upper edge margin does not exceed the elevation of the mid-point of the net's upper edge margin by more than approximately ¾" (2 cm) when the first and second ends of the net's upper edge margin are at approximately the same elevation; and moving the upper post sections of the first and second net standards between their raised and lowered positions without reducing the tension of the cable below the net-supporting tension.

2. A method as set forth in claim 1 further comprising providing a tensioning mechanism on the upper post section of the first net standard, and wherein the step of tensioning the net-supporting cable comprises using the tensioning mechanism to tension the net-supporting cable to the net-supporting tension.

3. A method as set forth in claim 1 further comprising providing a winch mechanism on the upper post section of the first net standard, and wherein the step of tensioning the net-supporting cable comprises using the winch mechanism to tension the net-supporting cable to the net-supporting tension.

4. A method as set forth in claim 3 wherein the winch mechanism moves with the upper post section of the first net standard as the upper post section of the first net standard is moved between its raised and lowered positions.

5. A method as set forth in claim 1 wherein each net standard further comprises a crank-operable drive mechanism having a crank rotatable about a crank axis, and wherein the upper post section of each net standard is moved between its raised and lowered positions by rotating the crank of the corresponding net standard about its crank axis.

6. A method as set forth in claim 1 wherein each net standard further comprises a drive mechanism operable to move the upper post section of the corresponding net standard between its raised and lowered positions, and wherein the step of moving the upper post sections of the first and second net standards is accomplished by operating the drive mechanisms.

7. A method as set forth in claim 6 wherein the drive mechanism of each net standard comprises a screw-type drive mechanism having an elongate screw extending generally along the post axis, and a threaded adjuster member threadably engageable with the elongate screw, the elongate screw being operatively connected to one of the upper and lower post sections in a manner to permit rotation of the screw about the post axis and relative to said one post section, the threaded adjuster member being operatively secured to the other of said upper and lower post sections, the upper and lower post sections and the adjuster member and the screw being arranged and configured so that rotation of the screw effectuates movement of the upper post section relative to the lower post section between its raised and lowered positions, and wherein the step of moving the upper post sections of the first and second net standards is accomplished by rotating the screws.

8. A method as set forth in claim 1 wherein:

the step of securing the first and second net standards to the support surface comprises securing the first and second net standards to the support surface in a manner so that the first and second net standards are spaced apart by at least 32 feet; and the step of providing the net and cable assembly comprises providing the net so that the distance between the first and second ends of the edge margin is at least thirty feet.

9. A method as set forth in claim 8 wherein the step of moving the upper post sections of the first and second net standards comprises lowering the upper post sections of the first and second standards to change the height of the mid-point of the net's upper edge margin from about 7 feet, 11⅝ inches to about 7 feet, 4⅛ inches without reducing the tension of the cable below the net-supporting tension.

10. A method of adjusting the height of a volleyball net comprising:

securing first and second net standards to a support surface, such as a floor, in a manner so that the net standards extend up from the support surface in a generally upright position, each net standard comprising a lower post section, an upper post section slidably connected to the lower post section for telescoping movement of the upper post section relative to the lower post section along a post axis between a raised position and a lowered position, and a drive mechanism operable to move the upper post section between its raised and lowered positions;

providing a net and cable assembly comprising a net and a net-supporting cable, the net having an upper edge margin and a cable-receiving sleeve at its upper edge margin, the upper edge margin having first and second ends and a mid-point midway between the first and second ends, the net-supporting cable extending through the cable-receiving sleeve of the net;

operatively connecting the net-supporting cable to the upper post sections of the first and second net standards in a manner so that the net is between the first and second net standards and extends downward from the net-supporting cable;

providing a tensioning mechanism on the upper post section of the first net standard;

using the tensioning mechanism to tension the net-supporting cable between the upper post sections of the first and second net standards to a net-supporting tension which is sufficiently great that the elevation of the first and second ends of the net's upper edge margin does not exceed the elevation of the mid-point of the net's upper edge margin by more than approximately ¾ (2 cm) when the first and second ends of the net's upper edge margin are at approximately the same elevation;

operating the drive mechanism of the first net standard to move the upper post section of the first net standard between its raised and lowered positions without reducing the tension of the cable below the net-supporting tension, and to move the tensioning mechanism therewith; and operating the drive mechanism of the second net standard to move the upper post section of the second net standard between its raised and lowered positions without reducing the tension of the cable below the net-supporting tension.

11. A method as set forth in claim 10 wherein the steps of operating the drive mechanisms of the first and second net standards comprises lowering the upper post sections of the first and second standards to change the height of the mid-point of the net's upper edge margin from about 7 feet, 11⅝ inches to about 7 feet, 4 1/18 inches without reducing the tension of the cable below the net-supporting tension.

12. A method as set forth in claim 10 wherein the steps of operating the drive mechanisms of the first and second net standards comprises raising the upper post sections of the first and second standards to change the height of the mid-point of the net's upper edge margin from about 7 feet, 4⅛ inches to about 7 feet, 11⅝ inches without reducing the tension of the cable below the net-supporting tension.

* * * * *